US007529346B2

(12) United States Patent
Gaudin et al.

(10) Patent No.: US 7,529,346 B2
(45) Date of Patent: May 5, 2009

(54) METHOD FOR STABILIZING THE SIZE OF A FOCAL SPOT OF AN X-RAY TUBE, AND X-RAY TUBE COMPRISING SUCH A METHOD

(75) Inventors: Christelle Gaudin, Palaiseau (FR); Philippe Blin, Maurepas (FR)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/737,404

(22) Filed: Apr. 19, 2007

(65) Prior Publication Data

US 2007/0258564 A1 Nov. 8, 2007

(30) Foreign Application Priority Data

Apr. 19, 2006 (FR) ..... 06 51363

(51) Int. Cl.
*H01J 35/14* (2006.01)

(52) U.S. Cl. ..... 378/138; 378/207

(58) Field of Classification Search ..... 378/91–94, 378/98, 98.2, 101, 109–114, 138, 207
See application file for complete search history.

(56) References Cited

U.S. PATENT DOCUMENTS 4,763,343 A * 8/1988 Yanaki ..... 378/110
5,633,907 A * 5/1997 Gravelle et al. ..... 378/121
6,652,143 B2 * 11/2003 Popescu ..... 378/207

FOREIGN PATENT DOCUMENTS

| | | | |
|---|---|---|---|
| DE | 4325351 | A1 | 1/1995 |
| EP | 0346530 | A | 12/1989 |
| JP | 07065989 | A | 3/1995 |
| JP | 61206140 | A | 9/1998 |
| WO | WO95/14941 | A | 6/1995 |
| WO | WO02/085079 | A1 | 10/2002 |

* cited by examiner

*Primary Examiner*—Jurie Yun
(74) *Attorney, Agent, or Firm*—Global Patent Operation

(57) ABSTRACT

In a method for stabilizing the size of a focal spot of an X-ray tube and contrast modulation function of a X-ray tube, the tube has a cathode comprising a concentrator and a heating filament. It has an anode is placed so as to be facing the cathode. With the filament, the cathode produces an electron beam bombarding the focal spot of the anode. A bias voltage is applied between a terminal of the filament and a terminal of the concentrator. The tube has means to measure the size of the focal spot and the function of contrast modulation. It also has means to regulate the size of the focal spot and the contrast modulation function by means of a bias voltage.

9 Claims, 3 Drawing Sheets

METHOD FOR STABILIZING THE SIZE OF A FOCAL SPOT OF AN X-RAY TUBE, AND X-RAY TUBE COMPRISING SUCH A METHOD

BACKGROUND

1. Field of the Invention

Embodiments of the invention provide a method for standardising the size of a focal spot of an X-ray tube, and find particularly advantageous but non-exclusive application in the field of medical imaging. However, embodiments of the invention can also be applied to other fields in which radiography or radiology examinations are made.

Embodiments of the invention are configured to control, optimise and standardise the size of the focal spot of an X-ray tube.

Embodiments of the invention may standardise a contrast modulation function in an image produced.

Embodiments of the invention may also keep the quality of the images produced constant in all the fields of operation of the X-ray tube.

Embodiments of the invention may also increase the service life or operating life of an X-ray tube.

Embodiments of the invention also relate to X-ray tubes configured to operate using a method described herein.

2. Description of the Prior Art

An X-ray tube, mounted in a medical radiology apparatus, comprises a cathode and an anode. The cathode and the anode are enclosed in a vacuum-tight envelope in order to set up electrical insulation between these two electrodes.

The cathode has a tungsten filament housed in a metal part with a shape appropriate to playing the role of an electronic lens, known as a concentration element or concentrator. The cathode produces an electron beam that is received by the anode on a small surface representing a focal spot from which the X-rays are emitted.

The filament is made incandescent by the flow of a current given by a generator connected to the terminals of the filament. When a positive voltage of some kilovolts relative to the cathode is applied to the anode, electrons emitted by the filament are accelerated towards the anode by the electrical field and bombard the anode or anti-cathode on a surface known as a focal spot. The focal spot thus becomes the main source of emission of X-radiation. The X-radiation is produced throughout the zone situated in front of the anti-cathode except for the grazing incidences.

At present, the image quality in radiology is linked, inter alia, to the dimensions of the focal spot of the X-ray tube. Studies on the sharpness and contrast factors of a radiology image are based on the known concept of the contrast modulation function. The studies clearly show that the greater the size of the focal spot, the greater the extent to which the image of an object is marred by fuzziness. This fuzziness is chiefly due to the superimposition of a large number of images coming from points constituted by the surface of the focal spot, since this focal spot itself is not a pinpoint spot.

In the prior art, to reduce the size of the focal spot, a negative, fixed bias voltage is applied to the concentrator. The greater the absolute value of this bias voltage, the greater the reduction of the size of the focal spot to an optimum value. This fixed bias voltage is determined for a given electron current of the tube or X-ray flow rate.

However, these X-ray tubes have drawbacks. During the operation of the X-ray tube, the shape of the energy profile of the focal spot varies. Consequently, the size of the focal spot and as well as the contrast modulation function varies substantially with the power supply voltage and the intensity of the electron current. This variation is inherent to the medical application, depending on the region to be examined. The variation of the contrast modulation function may impair the quality of the images produced.

This impairment may thus limit the resolution of a radiography image obtained from the focal spot, making it more difficult to detect small-sized microcalcifications for example, in the case of mammography.

The bias voltage applied to the tube is fixed and determined for a power supply voltage of the tube and/or for a given X-ray flow rate so as to adjust the size of the focal spot. The bias voltage is therefore no longer efficient when the power supply voltage and/or the electron current of the tube vary, giving rise to a variation in the size of the focal spot and, potentially, a reduction of the sharpness and contrast of the radiography image.

Furthermore, under the effect of the electron bombardment, the major part of the energy of the electrons incident to the focusing zone on the anode is converted into calorific energy. The heat thus collects on the anode which heats up. When there is a variation in the power supply voltage and the electron current of the tube, the associated variation in the size of the focal spot may lead to excessive energy being obtained. This excessive energy may damage the surface of said focal spot.

SUMMARY OF THE INVENTION

Embodiments of the invention overcome one or more of the drawbacks of the techniques explained above. To this end, embodiments of the invention proposes to modify the techniques of biasing the existing concentrator in order to control, compensate for and standardise firstly the size of the focal spot and, secondly, the contrast modulation function. Embodiments of the present invention thus enable instantaneous, high-precision checking and regulation of the size of the focal spot and the of contrast modulation function.

Embodiments of the invention may comprise means that can be used to maintain the contrast modulation function, length and width at constant values, whatever the power supply voltage of the tube and/or the X-ray flow rate.

To do so, an embodiment of the invention may comprise means of regulation of the contrast modulation function and of the dimensions of the focal spot in using a bias voltage. This bias voltage is produced and adjusted in embodiments of the invention by a function that depends on the power supply voltage and/or on the electron current of the tube, by means of a chart or nomograph or a computation function. This nomograph or computation function depends on the type of X-ray emitting material coating the anode. An embodiment of the invention comprises means to produce and control the adjustment of the bias voltage.

Embodiments of the invention can also be used for the analysis, for each applied bias voltage, of the thermal load of the focal spot on the anode and the heating current of the filament in order to measure the rate of impact that they exert on the tube in operating mode. This rate of impact is linked to the service life of the tube and its capacity to carry out a cycle of exposures. To optimise the operation of the tube, an embodiment of the invention provides for the inclusion of these measurements of the rate of impact in the production of the bias voltage in order to obtain a compromise between the stability of the contrast modulation function, the size of the focal spot and the tolerated impact rate. This analysis therefore enables embodiments of the invention to adjust the level of the desired contrast modulation function and the optimum size of the focal spot in taking account of the measurements of rate of impact, thus enabling the service life of the X-ray tube to be increased. To do this, an embodiment of the invention defines a range of operation of the tube in which this compromise is implemented.

Embodiments of the invention may comprise means to make the bias voltage vary as a function of variations in the size of the focal spot and/or the contrast modulation function. For certain applications of the X-ray tube, especially scanners, it is necessary to have several focal spots of emission each having different characteristics, for example different geometrical dimensions. An embodiment of a method of the invention may be applied to each of the focal spots of the scanner.

Embodiments of the present invention therefore relate to a fixed-anode or rotating-anode X-ray tube used to obtain radiology images, in which the sharpness and contrast are considerably improved and maintained.

More specifically, an embodiment of the invention provides a method for stabilizing the size of a focal spot of an X-ray tube, in which:

the tube is provided with a cathode comprising a concentrator and a heating filament, an anode is placed so as to be facing the cathode, with the filament, an electron beam is produced, bombarding the anode on a surface called a focal spot, a bias voltage is applied between a terminal of the filament and a terminal of the concentrator, the size of the focal spot is measured, a function of contrast modulation of an image produced is measured, wherein:

the size of the focal spot is regulated by means of the bias voltage, and the contrast modulation function is regulated by means of the bias voltage.

An embodiment of the invention also provides an X-ray tube comprising:

a cathode comprising a concentrator and a heating filament, an anode placed so as to be facing the cathode, the cathode emitting an electron beam bombarding a focal spot on the anode, an electrical circuit connected between the filament and the concentrator and producing a bias voltage, means for measuring the size of the focal spot, means for measuring a function of contrast modulation of an image produced, wherein the tube comprises:

means for regulating the size of the focal spot by means of the bias voltage, and means for regulating the function of contrast modulation by means of the bias voltage.

BRIEF DESCRIPTION OF THE DRAWINGS

Embodiments of the invention will be understood more clearly from the following description and the appended figures. These figures are given by way of an indication and in no way restrict the scope of the invention. Of these figures.

DETAILED DESCRIPTION OF EMBODIMENTS OF THE INVENTION

Figure 1:
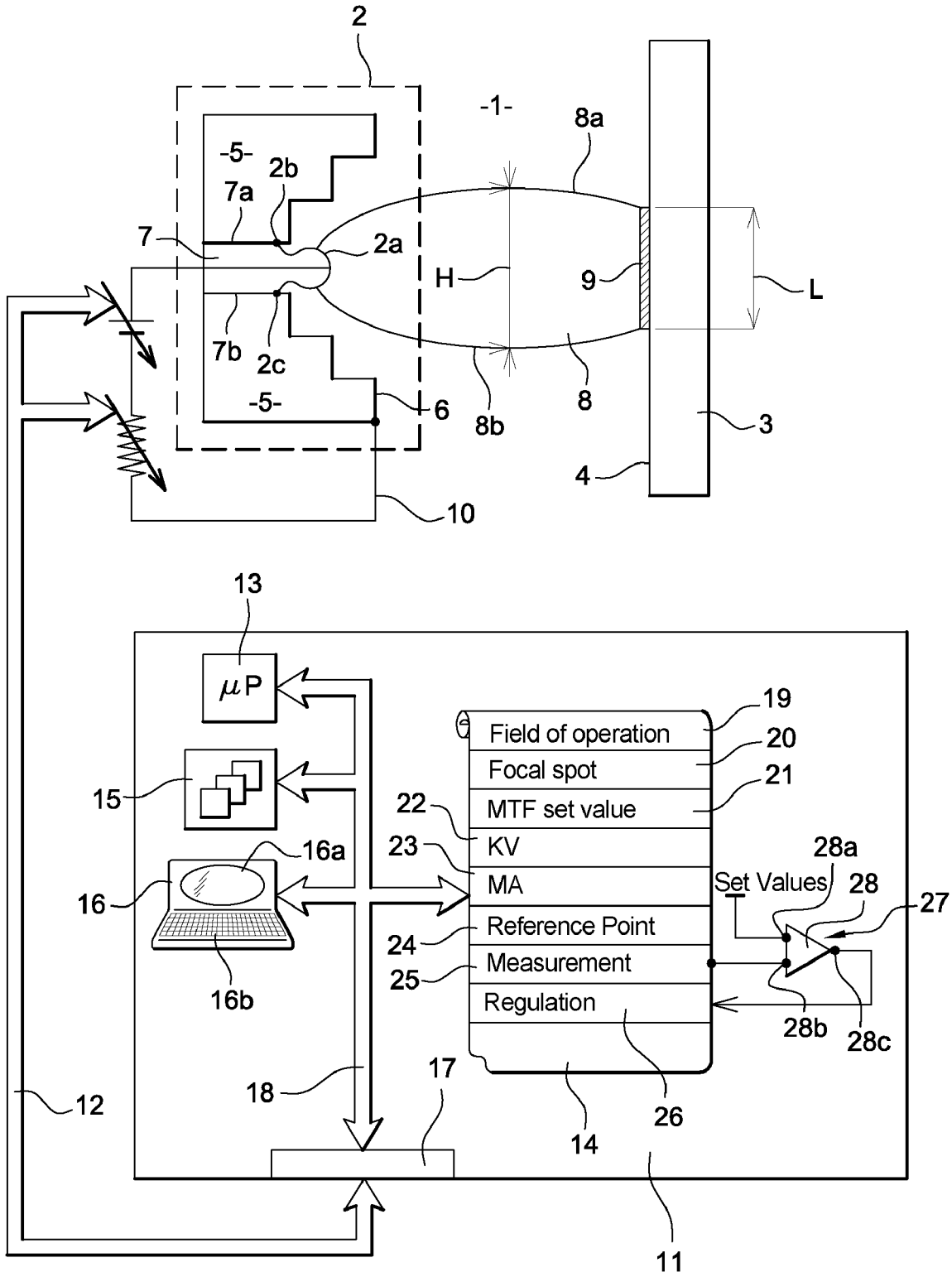
FIG. 1 illustrates means implementing an embodiment of a method of the invention.

FIG. 1 is a schematic view of the structure of an X-ray tube 1 configured according to an embodiment of the invention. The tube 1 has a cathode 2 and an anode 3, for example of a rotating type. The cathode 2 is either a direct cathode or an indirect cathode. The cathode 2 and the anode 3 are placed so as to be facing each other. They are both contained in a conventional way in a glass or metal envelope (not shown).

The anode 3 is constituted, at least partially, by an X-ray emitting material forming a massive structure with one surface that constitutes a plane face 4 of the anode 3 oriented towards the cathode 2.

The term "X-ray emitting material" is understood to mean a refractory material that is a good conductor of heat and has a highly atomic number of the kind commonly used to obtain X-rays under electron bombardment, for example a material such as tungsten, molybdenum, rhenium, rhodium, their alloys etc. Such materials are called target material here below in the description.

The cathode 2 has a heating filament 2*a*. This heating filament 2*a* is generally constituted by tungsten. The cathode 2 has a concentrator 5 in which the heating filament 2*a* is housed. The concentrator has a body 6 generated by revolution in which a diametrical groove 7 is made. This diametrical groove has two straight walls 7*a* and 7*b* 4 is linked. These two walls 7*a* and 7*b* separate the concentrator into two symmetrical parts. The concentrator 5 has a support made of insulating material, for example ceramic, through which the filament passes.

In one variant, the two parts of the concentrator may be electrically isolated from each other and from the filament 2*a*. In this case, a different voltage may be applied to each part of the concentrator.

During the application of high-power supply voltage by a generator (not shown) through power supply pins of the filament 2*a* and to the terminals of the anode 3, a current known as an anodic current is set up in the circuit through the generator. The anodic current crosses the space between the cathode 2 and the anode 3.

In order to obtain a high-energy electron beam 8, the electrons are accelerated by an intense electrical field produced between the cathode 2 and the anode 3. To this end, the anode 3 is taken to a very high positive potential relative to the potential of the cathode 2. The difference in potential is approximately between 10 and 150 kilovolts.

With the cathode 2 and the filament 2*a* being subjected to high voltage relative to each other, the cathode 2, more specifically the filament 2*a*, emits electrons at high speed which, in striking an exposed surface of the anode 3, prompts the emission of X-rays which are used to obtain a radiography shot, for example in medicine.

The concentrator 5 creates a distribution of the electrical field between the anode 3 and the filament 2*a* in such a way that the electron beam 8 is of the convergent type. Thus, the electrons emitted by the filament 2*a* are concentrated efficiently by the concentrator 5.

In general, a field of operation of the tube is defined by the voltage applied between the anode and the cathode and the current produced between the filament and the anode or electron current of the tube.

The electron beam 8 creates an X-ray emitting focal spot 9 on an exposed surface of the face 4 of the target material. The X-rays are emitted in all directions and come out of the envelope through a window of the tube in order to constitute a useful X-ray beam. The focal spot 9 is defined geometrically by a width and a length.

As shown in FIG. 1, the electron beam 8 is represented between two boundaries 8*a* and 8*b*. Between these boundaries, a height H of the section of the electron beam is formed. The projection of this electron beam on the exposed surface of the face 4 of the anode 3 tends to form the dimensions of the focal spot 9 in the width L of the face 4 of the anode 3.

The tube 1 furthermore has a bias circuit 10 used to apply a variable bias voltage V between the concentrator 5 and the filament. The bias circuit 10 is connected to a terminal of the filament 2*a* and to a terminal of the concentrator 5.

The tube 1 also has a control logic unit 11 connected by an external bus 12 to the bias circuit 10. The control logic unit 10 controls the variation in the bias voltage as a function especially of the size of the focal spot. This control logic unit 11 is preferably placed in the power supply generator. It may be placed at any other appropriate place of the tube 1.

The control logic unit 11 is often made in integrated circuit form. In one example, this control logic unit 11 comprises a microprocessor 13, a program memory 14, a data memory 15, a monitor 16, comprising a screen 16*a* and a keyboard 16*b*, and an input-output interface 17. The microprocessor 13, program memory 14, data memory 15, monitor 16 and input-output interface 17 are interconnected by a bus 18.

In practice, when an action is attributed to a device, it is carried out by a microprocessor of the device controlled by instruction codes recorded in a program memory of the device. The control logic unit 11 is such a device.

The program memory 14 is divided into several zones, each zone corresponding to instruction codes to fulfil one function of the device. Depending on the embodiment of the invention, the memory 14 comprises a zone 19 to determine a range of operation of the tube in which the efficiency of the tube is optimal. The measurements of the thermal load of the anode and of the heating current of the filament enable the control logic unit to define this range of operation.

The memory 14 has a zone 20 comprising instruction codes to define the set or instructed values for the appropriate size of the focal spot for the radiology examination to be made. These set values are those of the length and the width of the focal spot.

The memory 14 has a zone 21 comprising instruction codes to determine the set values of a contrast modulation function of an image produced. This contrast modulation function is a technique used to appreciate the variation in the quality of the image as a function of its spatial frequency. The contrast modulation function characterises the sharpness of the image. It provides information on the deterioration of an image.

These set values of the focal spot and of the contrast modulation function may be obtained by simulation or by measurements. The set values of the size of the focal spot and of the contrast modulation function are the same for each given type of tube. They differ from one type of tube to another type of tube. This provides for the same characteristics of focal spot size and contrast modulation function for each type of tube.

The memory 14 has a zone 22 comprising instruction codes to determine the appropriate high power supply voltage to be applied to the tube for the radiology examination to be made.

The memory 14 has a zone 23 comprising instruction codes to determine the appropriate X-ray flow rate for the radiology examination to be made.

The memory 14 has a zone 24 comprising instruction codes to determine a reference bias voltage to be applied between the concentrator 5 and the filament 2*a* as a function, for example, of nomograph or predefined computation rules. This reference bias voltage is produced according to several criteria including, for example, the target material of the anode, the working temperatures of the filament and of the anode, the set value of the size of the focal spot, the set value of the contrast modulation function. The setting up of the reference bias voltage makes it possible to scale the computation functions or the nomographs giving the bias voltage as a function of the power supply voltage and/or the electron current of the tube.

In an embodiment of the invention, the reference bias voltage is determined for the set value of the size of the focal spot for a power supply voltage and/or a current of the tube that are fixed.

The memory 14 has a zone 25 comprising instruction codes to perform real-time measurements of the dimensions of the size of the focal spot and of the contrast modulation function. The measurement zone 25 is also used to make measurements, for each power supply voltage and electron current of the tube, with the associated bias voltage, of the thermal load on the anode and of the heating current of the filament.

The memory 14 has a zone 26 comprising instruction codes to carry out a regulation of the size of the focal spot and/or of the contrast modulation function, when they vary as a function of the power supply voltage and/or the electron current of the tube. The zone 26 therefore enables, firstly, compensation for the variation of the contrast modulation function and, secondly, a stabilising of the size of the focal spot.

To this end, an embodiment of the invention comprises a comparison circuit 27. In a preferred embodiment, this comparison circuit 27 has a comparator 28 with two inputs 28*a* and 28*b* and one output 28*c*. At the input 28*a* of the comparator 28, the comparison circuit 27 respectively receives the set values of the size of the focal spot of the zone 20 and the set value of the contrast modulation function of the zone 21. At the input 28*b* of the comparator 28, the comparison circuit 27 respectively receives the instantaneous measurements of the dimensions of the focal spot and those of the contrast modulation function from the measurement zone 25. The output 28*c* of the comparison circuit 27, giving the result of the comparison, is connected to the regulation zone 26.

The comparator 28 makes a first comparison between the set values of the size of the focal spot of the zone 20 and measurements of the size of the focal spot of the measurement zone 25. It also simultaneously makes a second comparison between the set value of the contrast modulation function of the zone 21 and the measurement of the contrast modulation function of the measurement zone 25.

As soon as the result of the first and/or second comparison, given by the output 27*c*, is different from zero, the control logic unit executes the instruction codes of the regulations zone 26. This regulation zone 26 is used to adjust the reference bias voltage computed at the zone 24. This adjustment of the reference bias voltage compensates for the variations in the size of the focal spot and/or the contrast modulation function.

The variations of the reference bias voltage depend firstly on the variations in the size of the focal spot of the tube and secondly on the variations in the contrast modulation function, in the operating mode of said tube.

The comparison circuit 27 may be replaced by any other means that can be used to make a comparison. In the structure of the circuit 26, the components may be replaced by corresponding components. Similarly, other components may be interposed between the components described for the circuit 27.

The instruction codes of the regulation zone also take account of the measurements of thermal load of the anode and of the heating current of the filament. This gives a bias voltage that enables, firstly, the stabilising of the size of the focal spot and the contrast modulation function and, at the same time the optimizing of the efficiency of the tube.

Thus, whatever the power supply voltage of the tube and/or the X-ray flow rate, the control logic unit provides for stability of the contrast modulation function. Similarly, it maintains the performance of the size of the focal spot at a constant level, whatever the radiology examination to be made.

The measurements made on the size of the focal spot make it possible to determine and adjust the reference bias voltage in order to regulate said size of the focal spot. Thus, for each tube, the control logic unit applies an appropriate reference bias voltage. The functions of predefined computation of the bias voltage according to the power supply voltage and/or the electron current of the tube are adapted to each tube.

The reference bias voltage computed by the control logic unit enables the scaling of the predefined computation function for each tube. The adjustment of the reference bias voltage, as a function of the power supply voltage and/or the electron current of the tube, is adapted to each tube. Thus, whatever the tube, the size of the focal spot as well as the contrast modulation function are stabilised by this adjustment.

Furthermore, with embodiments of the invention, the bias voltage computation function is defined for each tube, thus making it possible to have the same image quality for each tube.

Because of manufacturing conditions, the concentrators 5 are not always identical to one another for each of the tubes. With the embodiments of the invention, whatever the concentrator 5, the control logic unit applies a appropriate reference bias voltage making it possible to adjust and stabilise the size of the focal spot.

In an embodiment of the invention, the control logic unit causes variation in the reference bias voltage produced by the zone 24 in order to effect a compromise between the optimum range of operation of the tube, the regulation of the dimensions of the focal spot and the stabilisation of the contrast modulation function.

Figure 2:
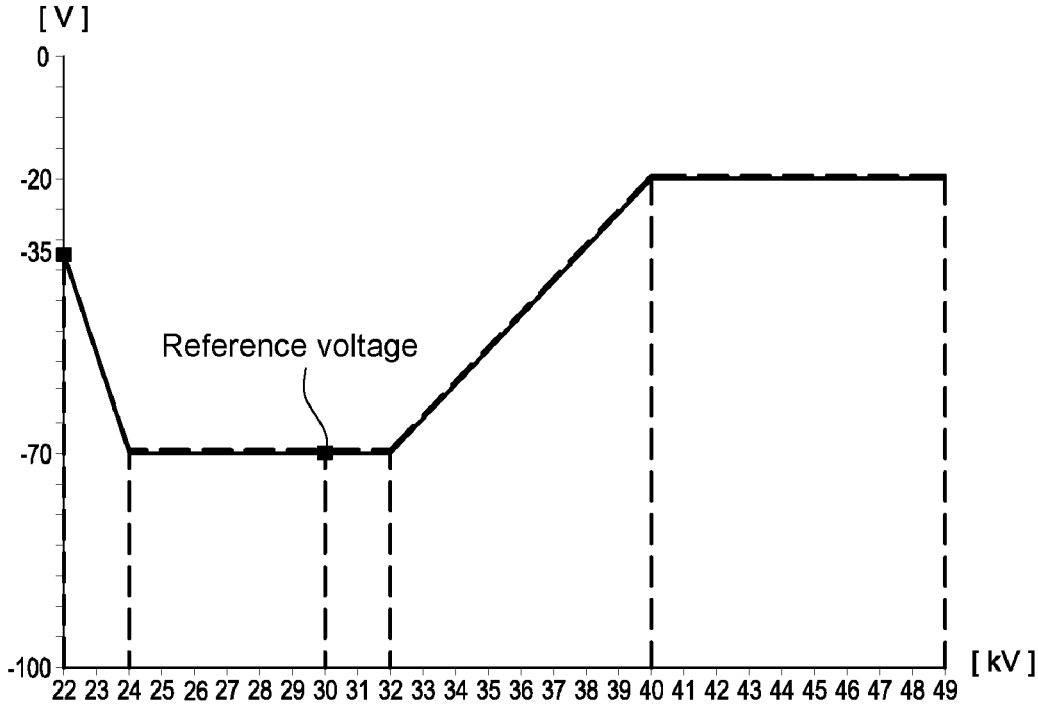
FIG. 2 is a graph determining a bias voltage as a function of a power supply voltage of the tube, for a large-sized focal spot of a molybdenum anode.
Figure 3:
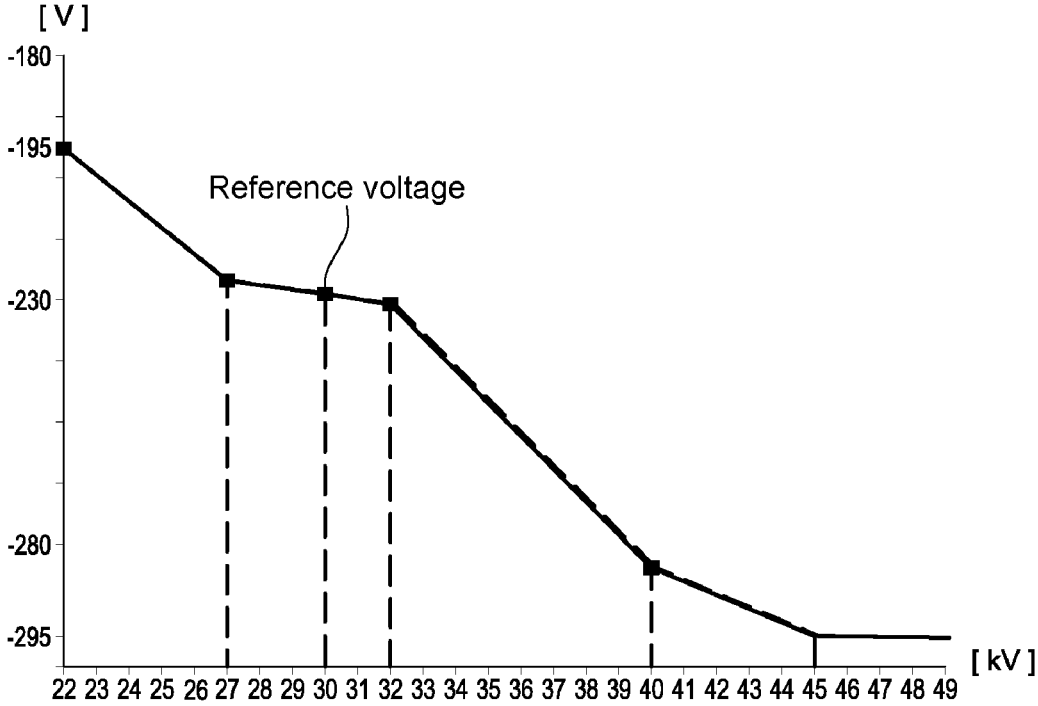
FIG. 3 is a graph determining a bias voltage as a function of a power supply voltage of the tube, for a small-sized focal spot of a molybdenum anode.
Figure 4:
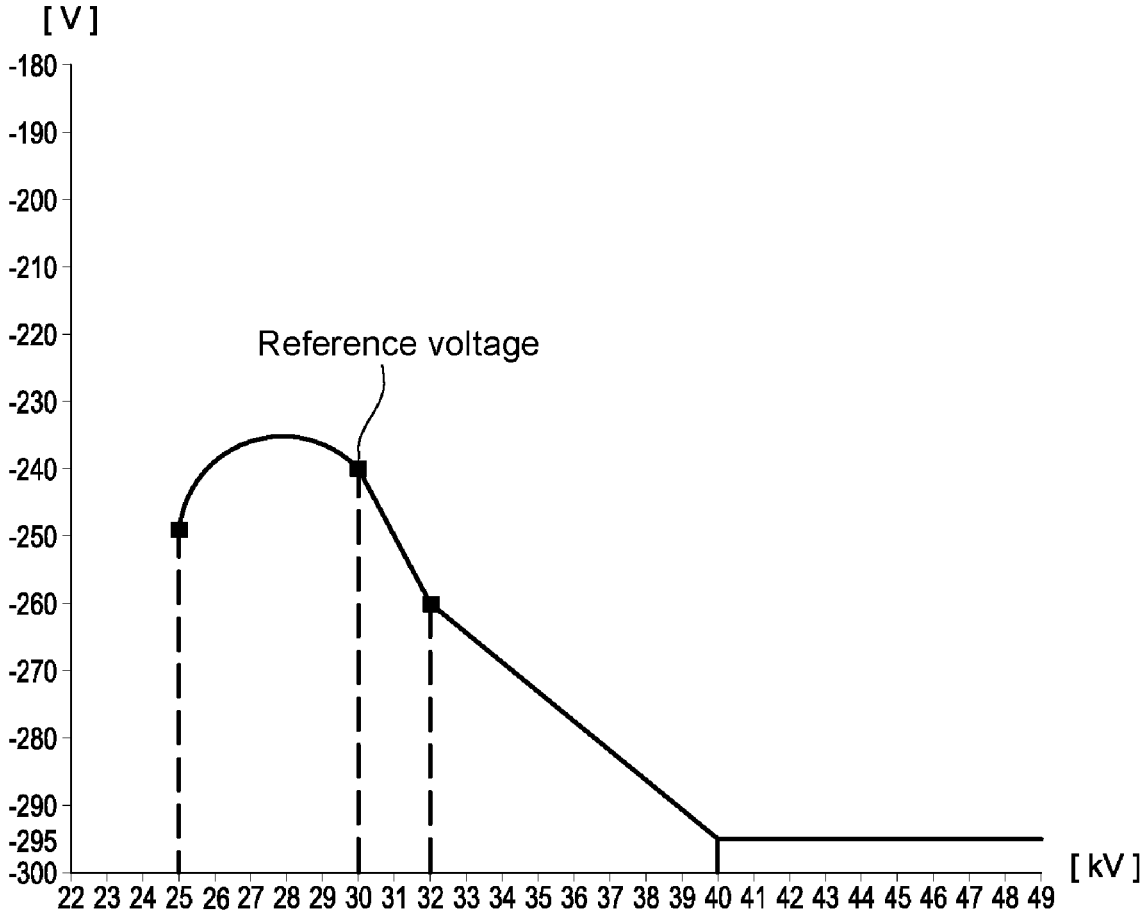
FIG. 4 is a graph determining a bias voltage as a function of a power supply voltage of the tube, for a small-sized focal spot of a rhodium anode.

FIGS. 2 to 4 give a view, in one example, of three types of graphs for determining the bias voltage through the instruction codes of the zone 21 of the logic control unit. These three types of determining graphs depend on the target material of the anode, the power supply voltage of the tube and/or the current of the tube. These determining graphs depend on the set values for the size of the focal spot and/or the set values for the contrast modulation function.

FIG. 2 gives a view, in a graph, of a mode of determining the bias voltage as a function of the power supply voltage of the tube. In one variant, the bias voltage may be determined as a function of the current of the tube.

In the example of FIG. 2, the target material of the anode is molybdenum. Furthermore, in the example of FIG. 2, the control logic unit produces a bias voltage for a focal spot size equal for example to 0.3 millimeters. The example of FIG. 2 can be used, for example, for a mammography examination.

In the graph of FIG. 2, the y-axis represents the bias voltage to be produced. This bias voltage varies between −100 volts and 0 volt. The x-axis represents the power supply voltage of the tube obtained at the zone 20. The power supply voltage varies between 22 kilovolts and 49 kilovolts.

An embodiment of the invention may first of all determine a reference bias voltage. This reference bias voltage is obtained in one example by measurement of the size of the focal spot for a given power supply voltage, a given tube current and a pre-fixed bias voltage.

This reference voltage may be determined by measurement of the focal spot in a specific field of operation of the tube. This specific field may be the optimum range of operation of the tube. The reference voltage may also be determined by a computation made on the characteristics of the real geometry of the tube.

In an embodiment, the reference voltage applied to FIGS. 2 to 4 is determined as a power supply voltage of 30 kilovolts. In the example of FIG. 2, for a reference power supply voltage of 30 kilovolts, the reference bias voltage is −65 volts.

When the tube is powered between 22 kilovolts and 24 kilovolts, excluding the latter value, the control logic unit determines the bias voltage to be applied in executing the following equation:

$$\text{Biasvoltage} = -9.025 \times (\text{kV} - 24) + e \int \text{referencevoltage}(30\ \text{kV})$$

Thus, for a power supply voltage situated between 22 kilovolts and 24 kilovolts, excluding the latter value, the control logic unit respectively determines a bias voltage situated between −33 volts and −65 volts. The absolute value of the bias voltage increases with a slope of 9.025.

When the tube is powered between 24 kilovolts and 32 kilovolts, the control logic unit applies a bias voltage equal to the reference bias voltage, in this case equal to −65 volts.

When the tube is powered between 32 kilovolts and 40 kilovolts, excluding these two values, the control logic unit determines the bias voltage to be applied in executing the following equation:

$$\text{Tension depolarisation} = \frac{\text{Référence}(30\ \text{kV}) + 20}{32 - 40} \times (\text{kV} - 32) + \text{Référence}(30\ \text{kV})$$

Thus, for a power supply voltage situated between 32 kilovolts and 24 kilovolts, the control logic unit respectively determines a bias voltage situated between −65 volts and −20 volts. The absolute value of the bias voltage diminishes linearly.

When the tube is powered between 40 kilovolts and 49 kilovolts, the control logic unit applies a bias voltage equal to −20 volts.

As can be seen in FIG. 2, the absolute values of the bias voltage are situated between 20 and 70 volts. In general, the greater the fall in the absolute value of the bias voltage, the greater is the increase in the size of the focal spot.

FIG. 3 is a graph showing the bias voltage to be produced for a small-size focal spot of, for example, 0.1 millimeters. The example of FIG. 3 can be used for example in a mammography examination. The target material of the anode here too is molybdenum.

In the graph of FIG. 3, the y-axis represents the bias voltage to be produced. This bias voltage varies between −300 volts and −180 volts. The x-axis represents the power supply voltage of the tube. The power supply voltage varies between 22 kilovolts and 49 kilovolts.

In the example of FIG. 3, for a reference power supply voltage of 30 kilovolts, the reference bias voltage is −225 volts.

When the tube is powered between 22 kilovolts and 27 kilovolts, excluding the latter value, the control logic unit determines the bias voltage to be applied in executing the following equation:

$$\text{Tension depolarisation} = -4.7467 \times (\text{kV} - 27) + \text{Référence}(30\ \text{kV}) + 0.7369 \times 3$$

Thus, for a power supply voltage situated between 22 kilovolts and 27 kilovolts, excluding the latter value, the control logic unit respectively determines a bias voltage situated between −195 volts and −225 volts. The absolute value of the bias voltage increases with a slope of 4.7467.

When the tube is powered between 27 kilovolts and 32 kilovolts, the control logic unit determines the bias voltage to be applied in executing the following equation:

$$\text{Tension depolarisation} = -0.7369 \times (\text{kV} - 30) + \text{Référence}(30\ \text{kV})$$

Thus, for a power supply voltage situated between 27 kilovolts and 32 kilovolts, the control logic unit respectively determines a bias voltage situated between −225 volts and −230 volts. The absolute value of the bias voltage increases slightly with a slope of less than 1.

When the tube is powered between 32 kilovolts, excluding this value, and 40 kilovolts, the control logic unit determines the bias voltage to be applied in executing the following equation:

$$\text{Tension depolarisation} = -5.5625 \times (\text{kV} - 32) + \text{Référence}(30\ \text{kV}) - 0.7369 \times 2$$

Thus, for a power supply voltage situated between 32 kilovolts, not including this value, and 40 kilovolts, the control logic unit respectively determines a bias voltage situated between −230 volts and −280 volts. The absolute value of the bias voltage increases with a slope of 5.5625.

When the tube is powered between 32 kilovolts, excluding this value, and 40 kilovolts, the control logic unit determines the bias voltage to be applied in executing the following equation:

$$\text{Tension depolarisation} = \frac{-295 - T.\text{polarisation}(40)}{45 - 40} \times (\text{kV} - 40) - 5.5625 \times 8 - 0.7369 \times 2 + Réf(30\ \text{kV})$$

Thus, for a power supply voltage situated between 40 kilovolts and 45 kilovolts, excluding these two values, the control logic unit respectively determines a bias voltage situated between −280 volts and −295 volts. The absolute value of the bias voltage increases slightly.

When the tube is powered between 45 kilovolts and 49 kilovolts, the control logic unit applies a bias voltage equal to −295 volts.

As can be seen in FIG. 3, the absolute values of the bias voltage are situated between 195 volts and 295 volts. In general, the greater the increase in the absolute value of the bias voltage, the greater is the diminishing of the size of the focal spot.

FIG. 4 is a graph showing the bias voltage to be produced for a small-size focal spot. The example of FIG. 4 can be used for example in a mammography examination. The target material of the anode here is rhodium. However, the production functions used to produce the bias voltage are different for the two FIGS. 3 and 4. This is due to the fact that the target material of the anode is different in the examples of FIGS. 3 and 4.

In the graph of FIG. 4, the y-axis represents the bias voltage to be produced. This bias voltage varies between −300 volts and −180 volts. The x-axis represents the power supply voltage of the tube, varying between 22 kilovolts and 49 kilovolts.

In the example of FIG. 4, for a reference power supply voltage of 30 kilovolts, the reference bias voltage is −240 volts.

When the tube is powered by a voltage between 25 kilovolts and 32 kilovolts, the control logic unit produces the bias voltage to be applied in executing the following equation:

$$\text{Tension depolarisation} = -0.82883 \times (\text{kV}^2 - 30^2) + 46.40212 \times (\text{kV} - 30) + \text{Référence}(30)$$

Thus, for a power supply voltage situated between 25 kilovolts and 32 kilovolts, the control logic unit respectively determines a bias voltage situated between −250 volts and −260 volts. The absolute value of the bias voltage varies parabolically.

When the tube is powered between 32 kilovolts and 40 kilovolts, excluding both these values, the control logic unit determines the bias voltage to be applied in executing the following equation:

$$\text{Tension depolarisation} = \frac{-295 - T\ \text{polarisation}(32\ \text{kV})}{40 - 32} \times (\text{kV} - 32) + T\ \text{polarisation}(32\ \text{kV})$$

Thus, for a power supply voltage situated between 32 kilovolts and 40 kilovolts, excluding both these values, the control logic unit respectively determines a bias voltage situated between −260 volts and −295 volts. The absolute value of the bias voltage increases linearly.

When the tube is powered between 40 kilovolts and 49 kilovolts, the control logic unit applies a bias voltage equal to −295 volts.

As can be seen in FIG. 4, the absolute values of the bias voltage are situated between 250 and 295. In general, the greater the increase in the absolute value of the bias voltage, the further does the size of the focal spot diminish.

FIGS. 2 to 4 show that, depending on the target material of the anode and the desired size of the focal spot, the control logic unit adapts the bias voltage production function to the power supply voltage.

In embodiments of the invention, the target material of the anode may be any other emitting material that can be used to practice the embodiments of the invention.

The control logic unit makes the bias voltage vary in order to stabilise the size of the focal spot and compensate for the contrast modulation function while at the same time optimising the thermal load of the anode for a given filament heating current. The control logic unit thus achieves a compromise between these different pieces of information to optimise the efficiency of the tube. It thus defines a range of operation of the tube taking this compromise into consideration. Consequently, for example, when the heating current of the filament increases sharply, the control logic unit may cause the bias voltage to vary in accepting a slight variation in the contrast modulation function if necessary, so as to reduce stress on the tube.

Embodiments of the invention, shown and described herein are illustrative only. Although only a few embodiments of the invention have been described in detail, those skilled in the art who review this disclosure will readily appreciate that substitutions, modifications, changes and omissions may be made in the design, operating conditions and arrangement of the preferred and other exemplary embodiments without departing from the spirit of the embodiments as expressed in the appended claims. Accordingly, the scopes of the appended claims are intended to include all such substitutions, modifications, changes, and omissions.

What is claimed is:

1. A method for stabilizing the size of a focal spot of an X-ray tube, the method comprising:

providing the tube with a cathode comprising a concentrator and a heating filament;

placing an anode to face the cathode;

bombarding the anode on a surface thereof called a focal spot with an electron beam produced with the heating filament;

applying a bias voltage between a terminal of the filament and a terminal of the concentrator;

measuring a size of the focal spot;

measuring a function of contrast modulation of an image produced;

regulating the size of the measured focal spot by comparing the measured focal spot to focal spot set values and adjusting the bias voltage accordingly; and regulating the measured contrast modulation function by comparing the measured contrast modulation function to contrast modulation function set values and adjusting the bias voltage accordingly.

2. A method according to claim 1, wherein the bias voltage is produced as a function of at least one of a power supply voltage of the tube and a electronic current of the tube as a function of a nomograph or a predefined computing function.

3. A method according to claim 2, wherein the production of the bias voltage, relative to the power supply voltage of the tube and/or the electronic current of the tube, further depends on a type of material of the anode and on the size of the focal spot.

4. A method according to claim 1, wherein a range of operation of the tube is defined as a function of a temperature of the anode, the temperature of the filament and the type of material of the anode.

5. A method according to claim 4, wherein a reference bias voltage is determined by measuring the size of the focal spot for a given power supply voltage, a given current of the tube and a pre-fixed bias voltage, this reference bias voltage is designed to scale one of a predefined computing function and a nomograph for each tube.

6. An X-ray tube comprising:

a cathode comprising a concentrator and a heating filament, an anode placed facing the cathode, the cathode emit an electron beam that bombards a focal spot on the anode, an electrical circuit connected between the filament and the concentrator and configured to produce a bias voltage, means for measuring the size of the focal spot, means for measuring a function of contrast modulation of an image produced, wherein the tube comprises:

means for regulating the measured size of the focal spot by comparing the measured size of the focal spot to focal spot set values and adjusting the bias voltage accordingly, and means for regulating the measured contrast modulation function by comparing the measured contrast modulation function to contrast modulation function set values and adjusting the bias voltage accordingly.

7. A tube according to claim 6, comprising:

means for producing the bias voltage as a function of a power supply voltage of at least one of the tube and an electron current of the tube.

8. A tube according to claim 7, wherein the means of producing the bias voltage further depends on at least one of: a temperature of the anode, a temperature of the filament, an emissive material coating the anode, and a size of the focal spot.

9. A tube according to claim 7, wherein the means of producing the bias voltage is distinct from said tube.

* * * * *